US007595782B2

(12) United States Patent
Herrmann

(10) Patent No.: US 7,595,782 B2
(45) Date of Patent: Sep. 29, 2009

(54) LIQUID CRYSTAL DISPLAY WITH INTEGRATED DIGITAL-ANALOG-CONVERTERS

(75) Inventor: Frederick P. Herrmann, Sharon, MA (US)

(73) Assignee: Kopin Corporation, Taunton, MA (US)

( * ) Notice: Subject to any disclaimer, the term of this patent is extended or adjusted under 35 U.S.C. 154(b) by 953 days.

(21) Appl. No.: 10/775,765

(22) Filed: Feb. 10, 2004

(65) Prior Publication Data

US 2004/0207779 A1 Oct. 21, 2004

Related U.S. Application Data

(60) Provisional application No. 60/446,651, filed on Feb. 11, 2003.

(51) Int. Cl.
*G09G 3/36* (2006.01)

(52) U.S. Cl. ..... 345/98; 345/87; 345/90; 345/100; 345/103

(58) Field of Classification Search ..... 345/87–104
See application file for complete search history.

(56) References Cited

U.S. PATENT DOCUMENTS

| | | | | |
|---|---|---|---|---|
| 4,908,609 | A * | 3/1990 | Stroomer | 345/88 |
| 5,130,829 | A | 7/1992 | Shannon | |
| 5,619,225 | A | 4/1997 | Hashimoto | |
| 6,040,812 | A | 3/2000 | Lewis | |
| 6,046,719 | A | 4/2000 | Dingwall | |
| 6,281,891 | B1 | 8/2001 | DaCosta et al. | |
| 6,429,844 | B1 | 8/2002 | Yoon | |
| 6,445,325 | B1 | 9/2002 | Burns | |
| 6,577,302 | B2 | 6/2003 | Hunter et al. | |
| 6,683,596 | B2 | 1/2004 | Ozawa | |
| 6,897,843 | B2 * | 5/2005 | Ayres et al. | 345/90 |
| 2001/0026251 | A1 | 10/2001 | Hunter et al. | |
| 2002/0054005 | A1 | 5/2002 | Edwards et al. | |
| 2002/0063671 | A1 | 5/2002 | Knapp | |
| 2002/0122021 | A1 | 9/2002 | Hector et al. | |
| 2002/0122032 | A1 | 9/2002 | Hector et al. | |
| 2002/0135557 | A1 | 9/2002 | Janssen et al. | |
| 2003/0076288 | A1 | 4/2003 | Fish | |
| 2003/0146896 | A1 * | 8/2003 | Sekine | 345/98 |

FOREIGN PATENT DOCUMENTS

| | | |
|---|---|---|
| EP | 0 273 995 A1 | 7/1988 |
| EP | 0 540 163 B1 | 1/1997 |

* cited by examiner

*Primary Examiner*—Richard Hjerpe
*Assistant Examiner*—Vince E Kovalick
(74) *Attorney, Agent, or Firm*—Hamilton, Brook, Smith & Reynolds, P.C.

(57) ABSTRACT

An apparatus and method can convert digital data to analog data using column load capacitances on adjacent pairs of column lines of the LCD. The apparatus includes a data bus containing digital data. A row buffer is coupled to the data bus for receiving and distributing the digital data. A switch network is coupled to the row buffer for converting the digital data received from the row buffer to analog data using column load capacitances on adjacent pairs of column lines of the LCD.

19 Claims, 12 Drawing Sheets

$Bit_2 = 1$

EQUALIZE

LIQUID CRYSTAL DISPLAY WITH INTEGRATED DIGITAL-ANALOG-CONVERTERS

RELATED APPLICATION

This application claims the benefit of U.S. Provisional Application No. 60/446,651, filed on Feb. 11, 2003, the entire teachings of which are incorporated herein by reference.

BACKGROUND

Liquid crystal display (LCD) devices usually consist of two-dimensional arrays of thin-film circuit elements (pixels). Each pixel cooperates with liquid-crystal material to either transmit or prevent light travel through a column of liquid crystal material. The physical size of the pixel array is determined by the application.

A two-dimensional (2D) array, for example, can include two sets of conductive lines extending in perpendicular directions. Each line extending in one direction can provide signals to a column of the array; each line extending in another direction can provide signals to a row of the array.

Conventionally, each row-column position in a 2D array includes a pixel that responds to signals on the lines for the pixel's row and column combination. Through one set of parallel lines, illustratively called "data lines," each pixel receives signals that determine its state. Through the other set of parallel lines, illustratively called "scan lines," each pixel along a scan line receives a signal that enables the pixel to receive signals from its data line.

In conventional arrays, each scan line provides a periodic scan signal that enables a component in each pixel connected to the scan line to receive a signal from its data line during a brief time interval of each cycle. Therefore, tight synchronization of the scan signals with signals on the data lines is critical to successful array operation. Tight synchronization in turn requires that the driving signals to the data lines be provided with precise timing.

The circuitry driving the data lines is termed the "data scanner." The circuitry driving the scan lines is termed the "select scanner."

The arrays are built on substrates, usually of glass or quartz. The pixel arrays require driving and interface circuitry, and in most cases this circuitry is analog rather than digital, making the circuitry capable of delivering or sensing a range of input signals. However, in many applications the video signal originates in digital form and must be converted to analog form to drive the display. Suitable digital-to-analog (DAC) conversion circuitry can be built using well-known techniques in conventional silicon integrated circuits (ICs). These ICs are mounted on or adjacent to the substrate containing the pixel array and a large number of electrical connections are made between the two. The cost of the peripheral drive, interface chips, mounting, and electrical connections to the display can constitute a significant proportion of the overall cost of a system containing the display.

SUMMARY

If the ICs and connections can be eliminated or greatly reduced by integrating suitable circuitry on the substrate, then the system cost can be reduced and its reliability improved.

An apparatus and method can convert digital data to analog data using column load capacitances on adjacent pairs of column lines of the LCD. The apparatus can include a data bus containing digital data. A row buffer can be coupled to the data bus for receiving and distributing the digital data. A switch network can be coupled to the row buffer for converting the digital data received from the row buffer to analog data using column load capacitances on adjacent pairs of column lines of the LCD.

The switch network can include a plurality of switching devices, where each switching device can be coupled to an adjacent respective pair of column lines of the LCD. Each switching device can include a logic circuit which can receive digital data from the row buffer and at least three MOSFETs which can convert the received digital data received from the logic circuit to analog data and transmit the analog data through respective column lines. The MOSFETs can be n-channel MOSFETs, p-channel MOSFETs, or a combination of n-channel and p-channel MOSFETs.

A first column line of the pair of column lines can be coupled to alternating pixels in a first column of pixels and a second column line of the pair of column lines can be coupled to alternating pixels in a second column of pixels. The pixels of the first column line can be in alternating rows with respect to the pixels in the second column line.

The pixels can be arranged in a rectangular layout for a black and white display or the pixels can be arranged in a delta layout for a color display.

BRIEF DESCRIPTION OF THE DRAWINGS

The foregoing and other objects, features and advantages of the invention will be apparent from the following more particular description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
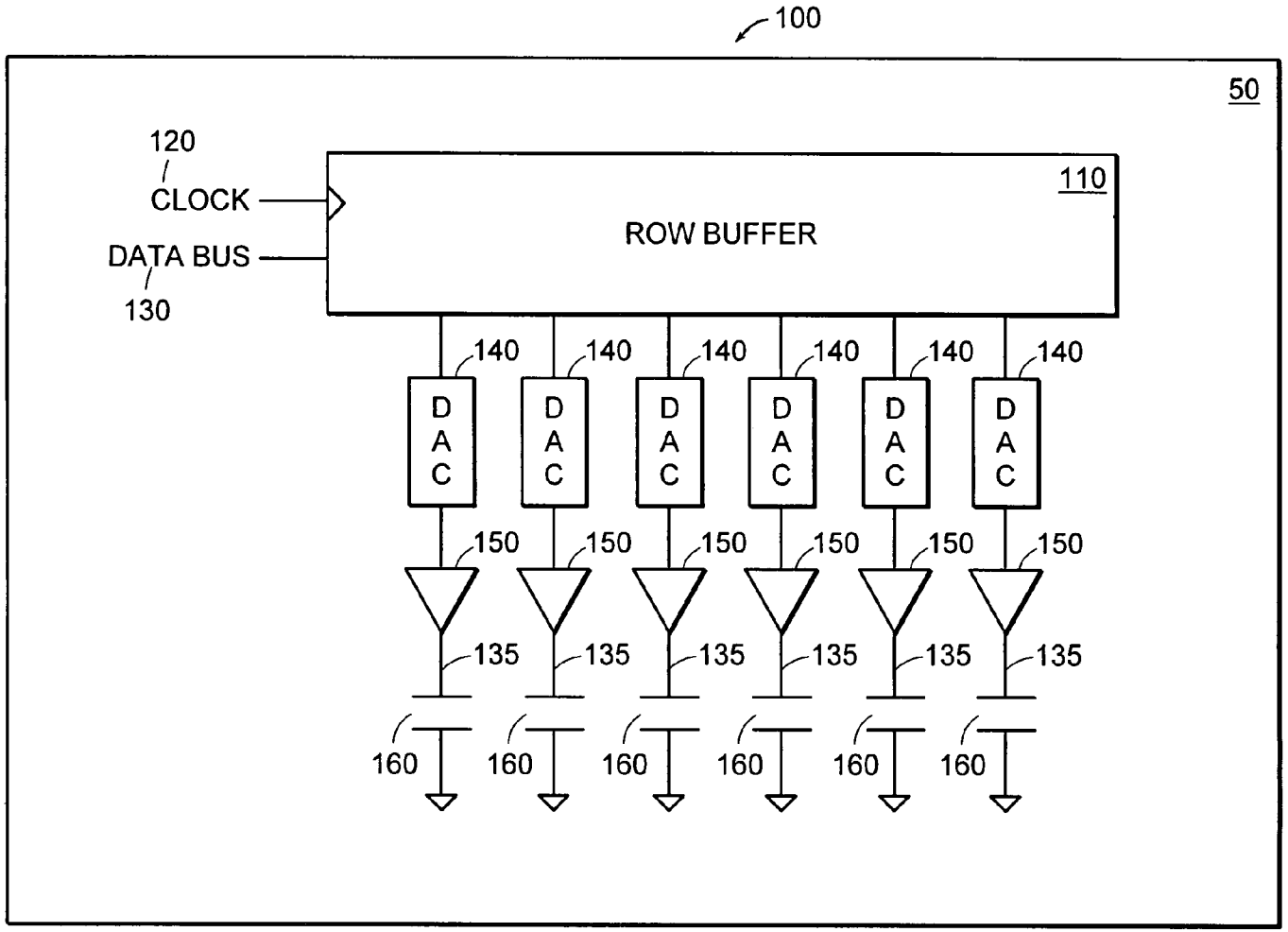
FIG. 1 PRIOR ART
FIG. 1 is a schematic representation of a prior art data scanner.

FIG. 1 shows a data scanner 50 and column load capacitances 160 of an LCD 100. The data scanner 50 includes integrated DACs 140 and amplifiers 150 to drive the column load capacitance 160 of the display 100. The configuration can be used to drive the column load capacitances 160 of black and white (B/W) or color displays. Generally, a row buffer 110 distributes digital data arriving from a data bus 130 to the DACs 140 on a pulse received from a clock 120. The DACs 140 operate in parallel and receive the digital data and convert the digital data to analog signals. Because the DACs 140 typically provide a high impedance output, display applications need the amplifiers 150 to drive the column load capacitance 160. In particular, the switched-capacitor DACs 140 require the amplifiers 150 because the column load capacitances 160 are typically greater than practically realizable DAC capacitors 330, 340 (FIGS. 3A-3I). Thus, the amplifiers 150 provide a greater output to the column load capacitances 160 of column lines 135 of the display 100.

Figure 2A:
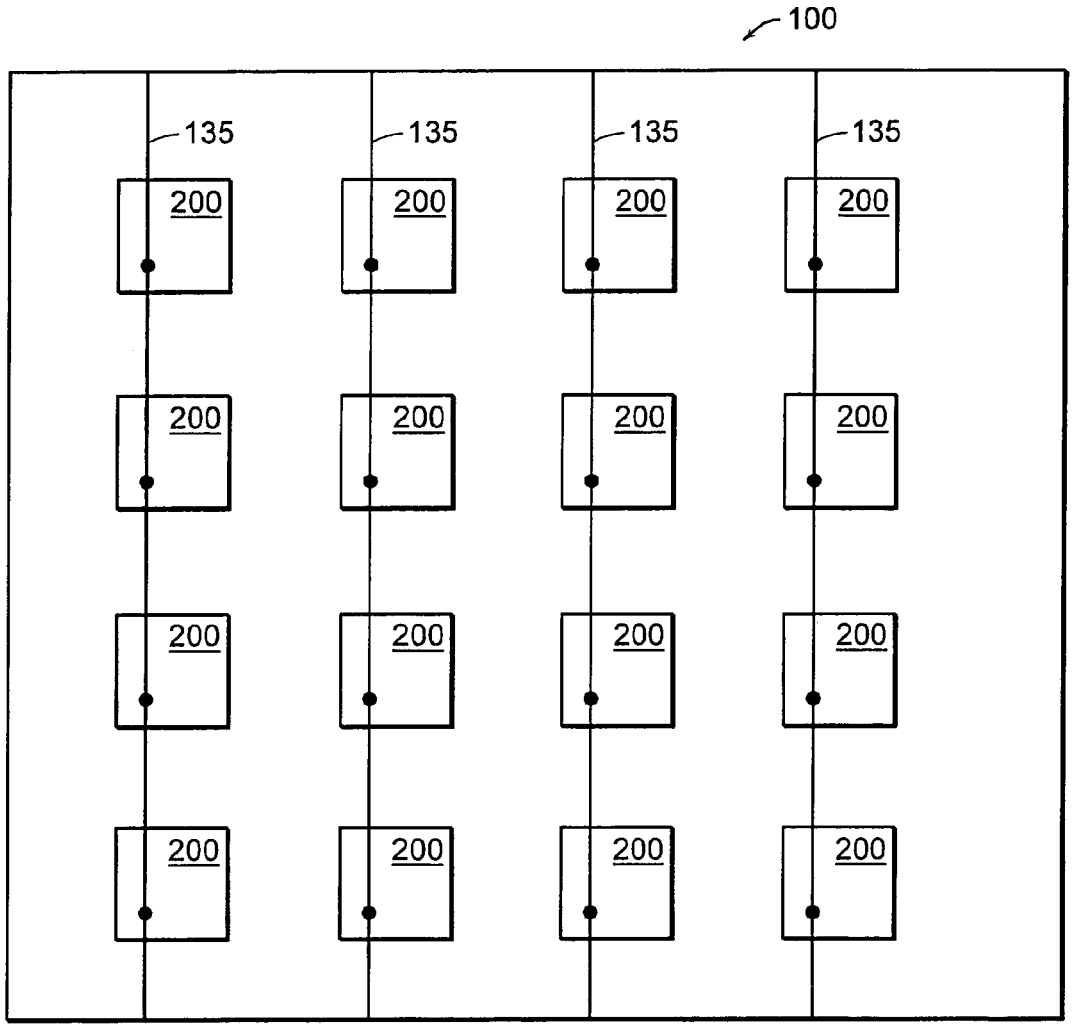
FIG. 2A PRIOR ART
FIG. 2A is a schematic representation of a typical pixel layout for a black and white (B/W) display for the data scanner of FIG. 1.
Figure 2B:
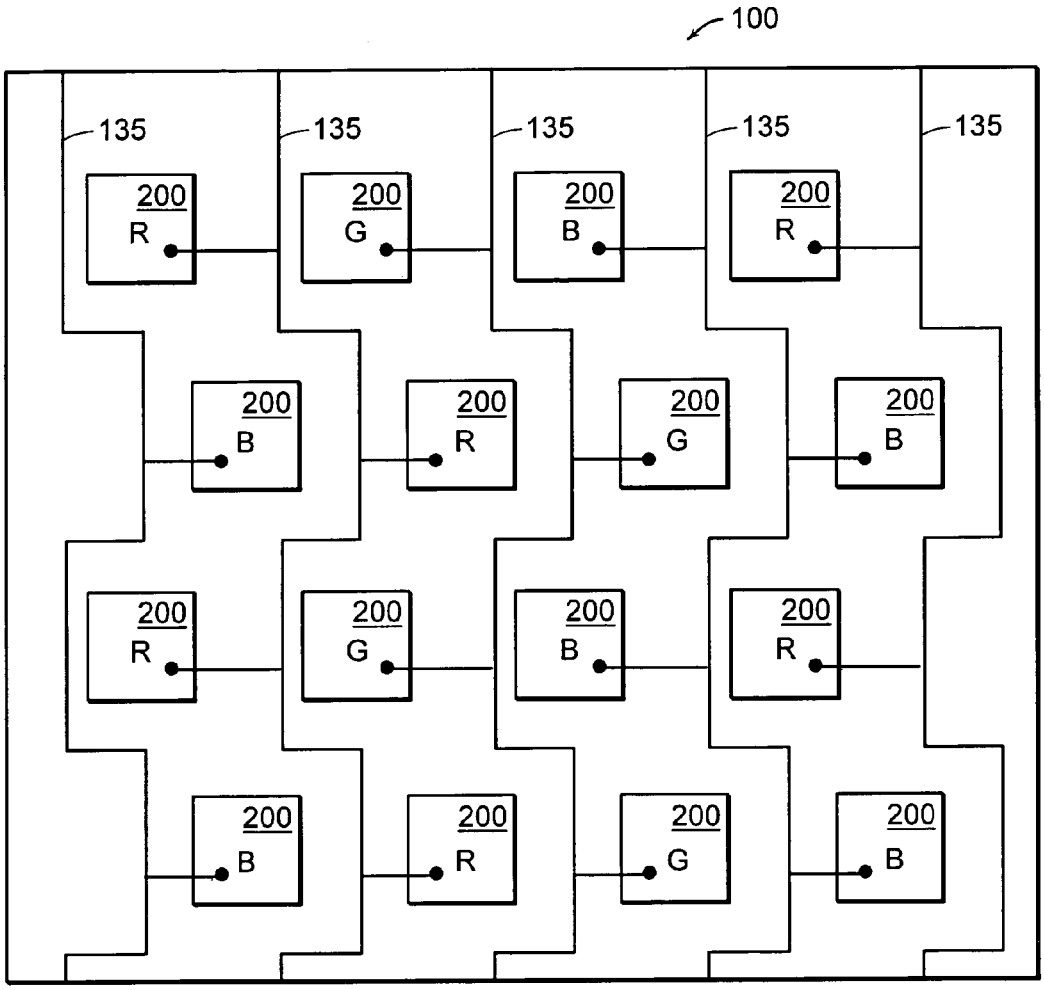
FIG. 2B PRIOR ART
FIG. 2B is a schematic representation of a typical pixel layout for a color display for the data scanner of FIG. 1.

FIG. 2A shows a typical pixel array and column line 135 layout for a display 100 with pixels 200 in a "rectangular" arrangement, while FIG. 2B shows a typical pixel array and column line 135 layout for a display 100 with pixels in a "delta" arrangement. The "rectangular" arrangement is commonly used for B/W displays, while the "delta" arrangement is commonly used for color displays. The letters RGB stand for Red, Green, and Blue and are well known in the art for color displays. Rectangular pixels 200 are used in both black-and-white and color displays, typically with square pixels for monochrome and rectangular stripes (height:width ratio=3:1) for color.

Figure 2C:
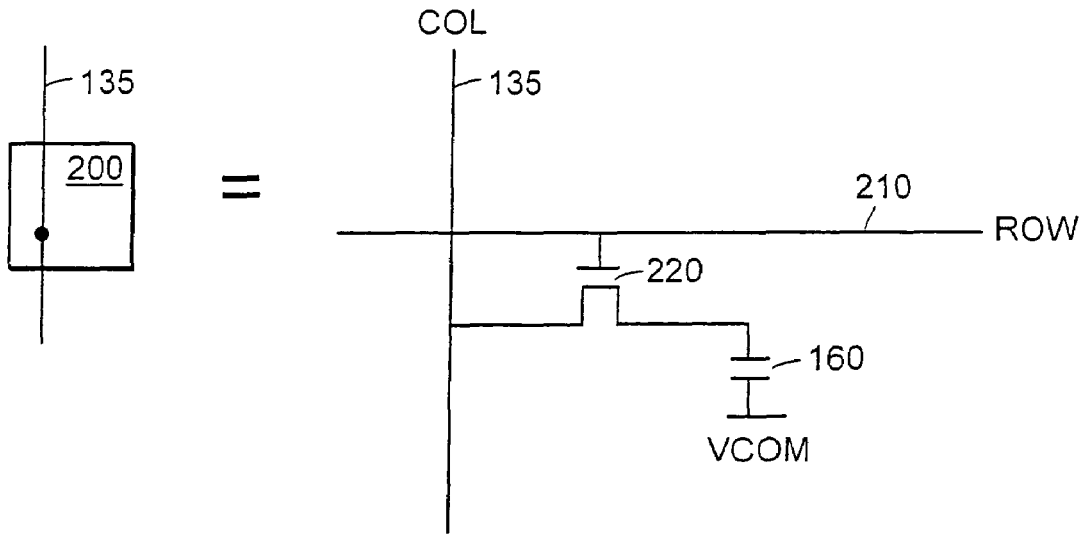
FIG. 2C PRIOR ART
FIG. 2C is a circuit diagram of a typical pixel of FIGS. 2A and 2B.
Figure 3A:
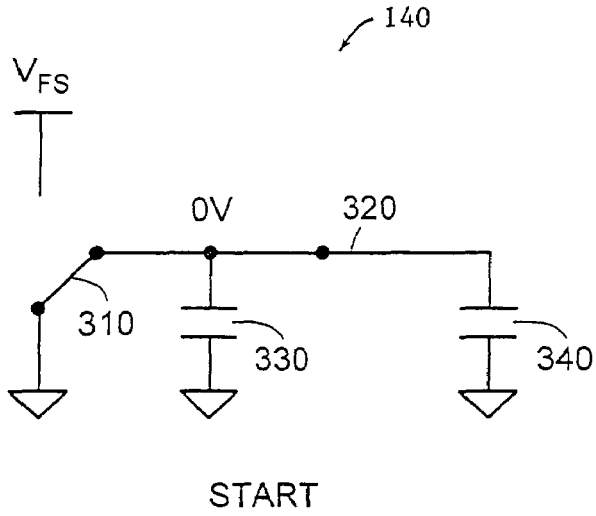
FIG. 3A PRIOR ART
FIGS. 3A-3I are circuit diagrams of a DAC of FIG. 1 converting a digital signal to an analog signal.
Figure 3B:
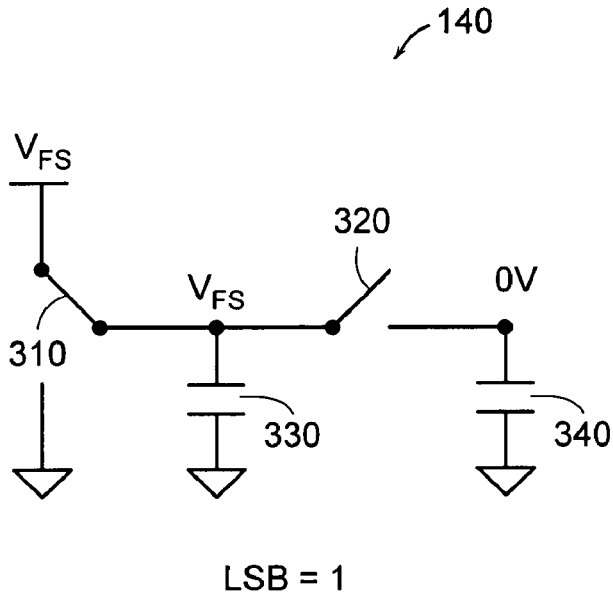
FIG. 3B PRIOR ART
Figure 3C:
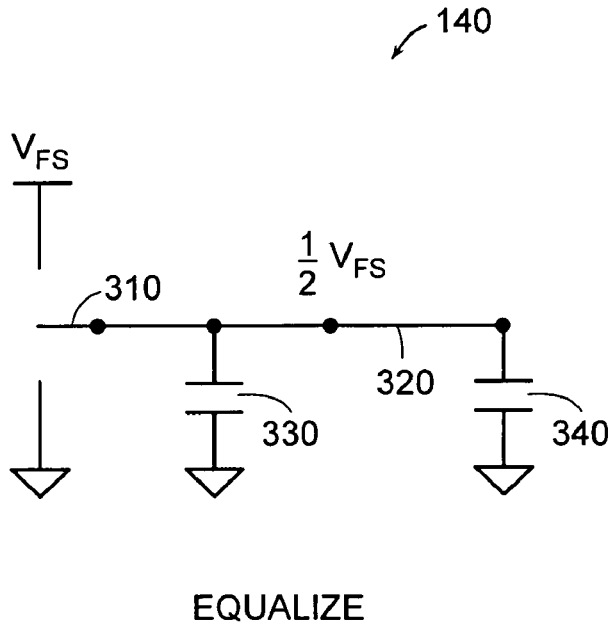
FIG. 3C PRIOR ART
Figure 3D:
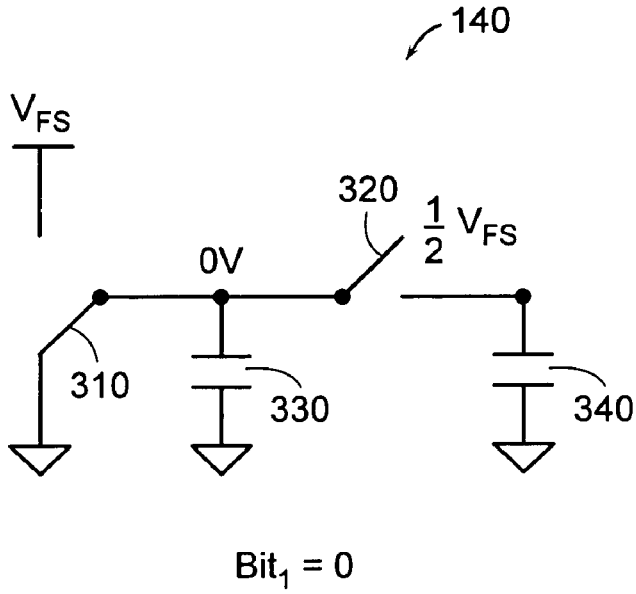
FIG. 3D PRIOR ART
Figure 3E:
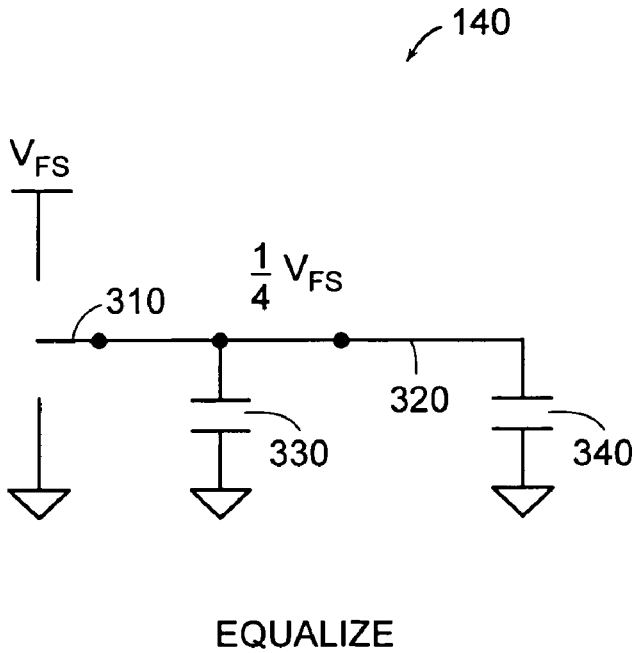
FIG. 3E PRIOR ART
Figure 3F:
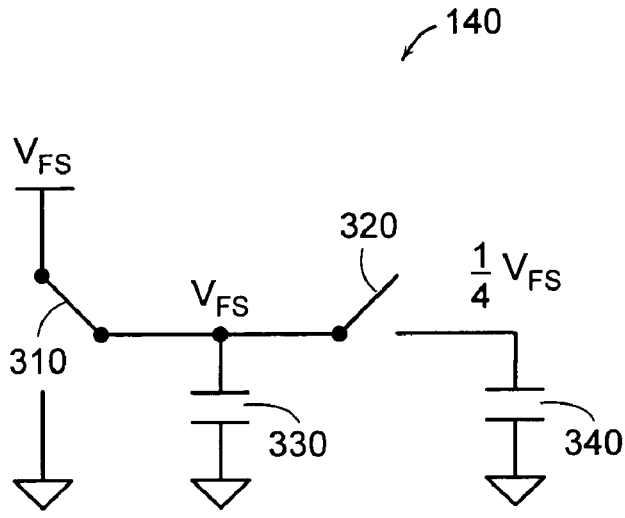
FIG. 3F PRIOR ART
Figure 3G:
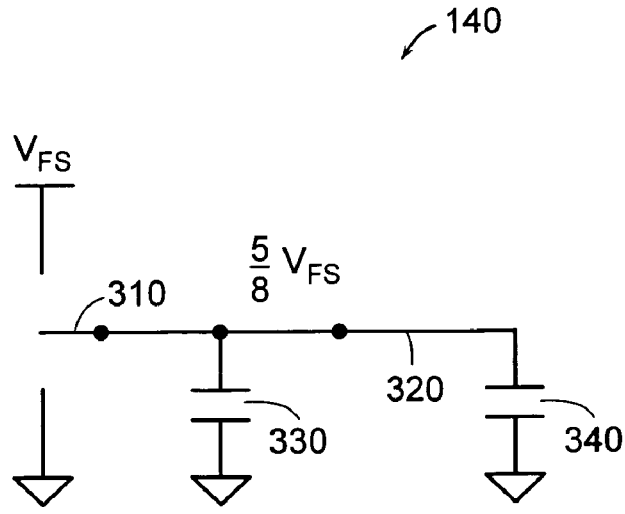
FIG. 3G PRIOR ART
Figure 3H:
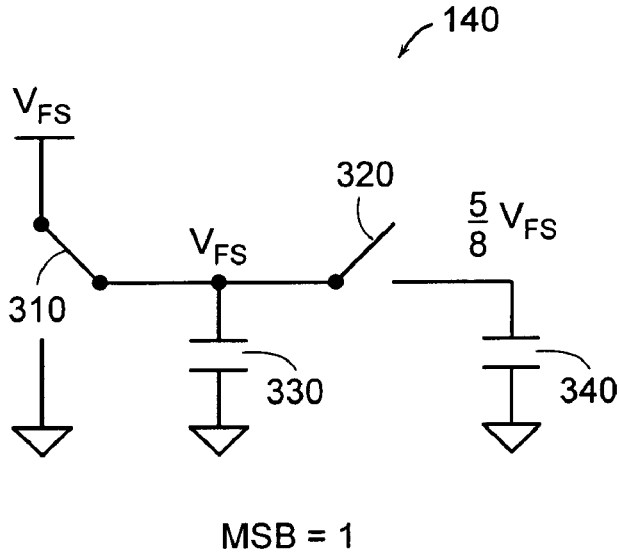
FIG. 3H PRIOR ART
Figure 3I:
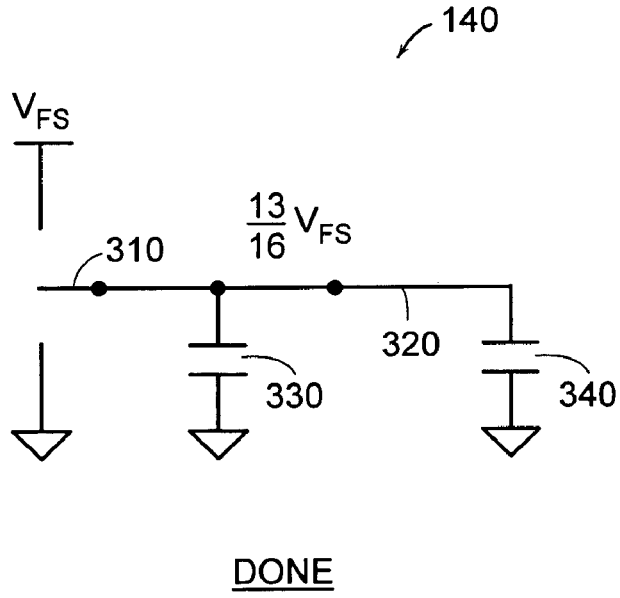
FIG. 3I PRIOR ART

FIG. 2C shows a circuit diagram of a typical pixel 200 as shown in FIGS. 2A and 2B. The typical pixel 200 includes a MOSFET transistor 220 and a capacitor 160. Each pixel 200 is connected to a row line 210 and a column line 135. The row line 210 controls the gate of MOSFET 220, which turns the pixel on and off. When the MOSFET 220 is turned on, the pixel 200 is driven by the column load capacitance 160 (FIG. 1) on the column line 135.

FIGS. 3A-3I shows a switched-capacitor DAC 140 converting a digital signal to an analog signal. The simple bit-serial DAC 140 includes two capacitors 330, 340 and two switches 310, 320. Switch 310 may be connected high, connected low, or left open. Switch 320 may connect the top plates of capacitors 330 and 340 or may be left open. Bit-parallel DACs using more capacitors and appropriate switch configurations can also be used. In this example, as illustrated sequentially in FIGS. 3A-3I, a 16 bit digital input code, 1101 or 16 decimal, is converted to an analog signal which is $^{13}/_{16}$ $V_{FS}$, where $V_{FS}$=full-scale output voltage.

Numerous problems arise when using switch-capacitor DACs 140 and associated amplifiers 150 (FIG. 1). First, the capacitors 330, 340 of the DACs 140 must be well-matched for predictable charge sharing. The example of FIGS. 3A-3I relies on the capacitors 330, 340 being equal, so that the charge is shared equally when switch 320 is closed. Second, it is hard to integrate DACs 140 on fine pitch column lines 135 because more area is needed for well-matched DAC capacitors 330, 340. If the DAC capacitors 330, 340 are too small, then undesirable parasitic capacitances become more significant. Third, it is hard to integrate numerous amplifies 150 (FIG. 1) on the display 100 because the amplifiers 150 need to be low power, have good matching (i.e., to prevent vertical lines in the image), and be integrated with fine pitch column lines. Lastly, multiplexers may need to be used to share DACs 140 and amplifiers 150 because of size restrictions, adding more complexity to the display 100.

Figure 4:
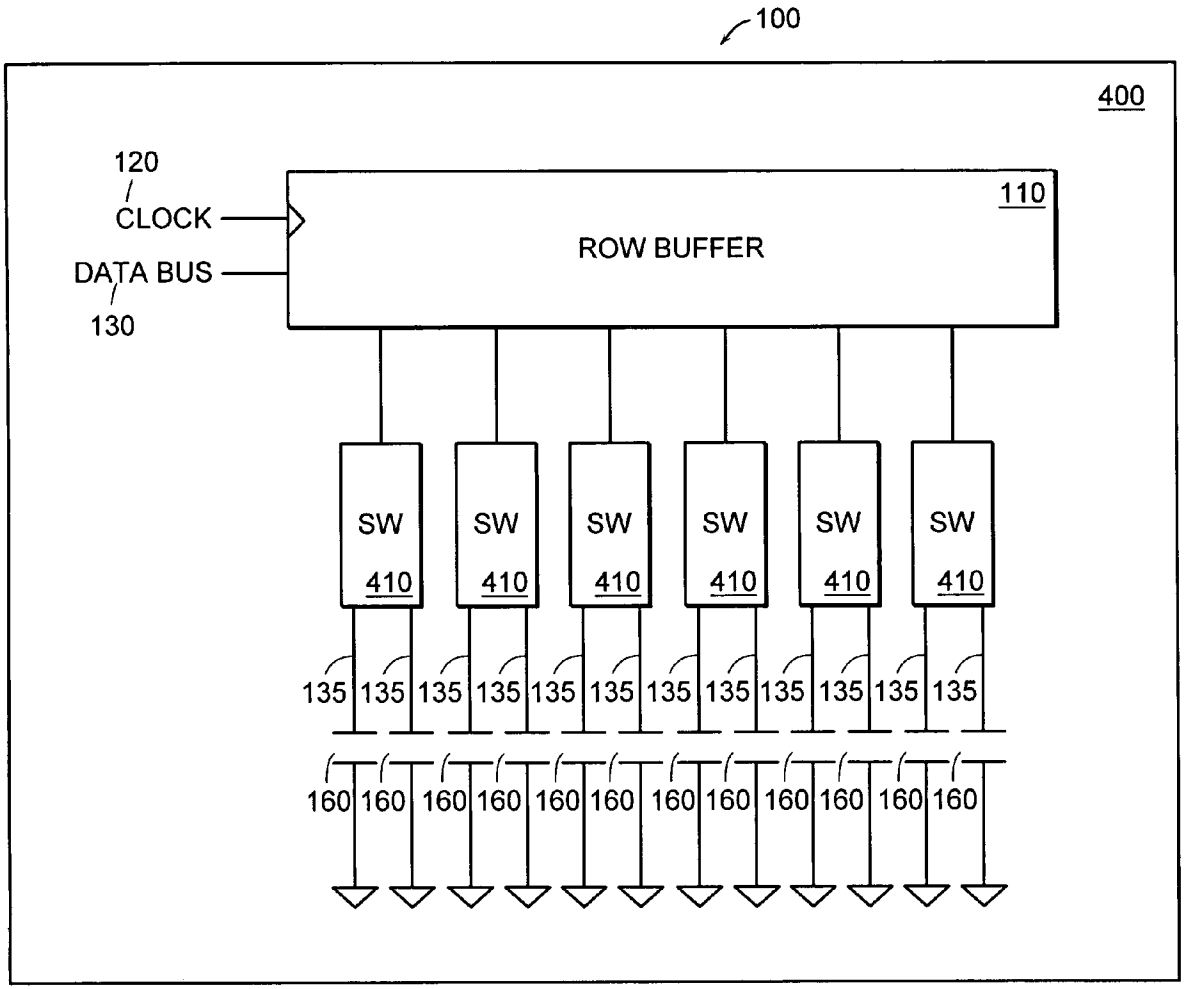
FIG. 4 is a schematic representation of a data scanner according to an embodiment of the present invention.

Embodiments of the present invention eliminate the need for specific switched-capacitor DACs 140 and their associated amplifiers 150. As shown in FIG. 4, the DACs 140 and amplifiers 150 (FIGS. 1-3I) of the data scanner 50 are replaced by a switch network that utilizes the column line capacitances 160 to convert the digital signals to analog signals. That is, new switched capacitor DACs are constructed using the switch network and the column load capacitances 160 as the DAC capacitors. In this configuration, a row buffer 110 distributes digital data arriving from a data bus 130 to switches 410 on a pulse received from a clock 120. The switches 410 convert the digital data to analog signals using the column load capacitances 160 of an adjacent pair of column lines 135.

Figure 5A:
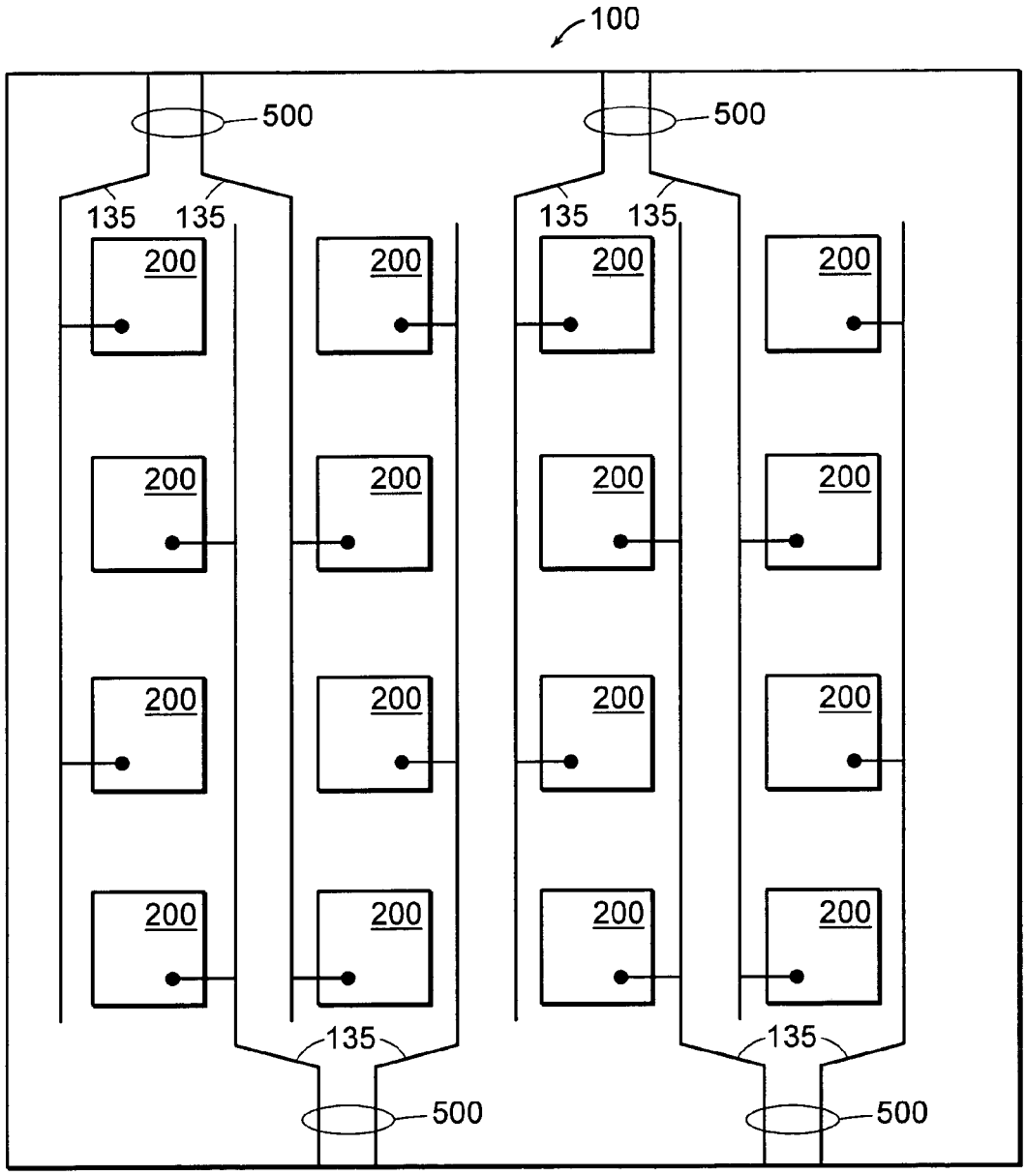
FIG. 5A is a schematic representation of a typical pixel layout for a B/W display for the data scanner of FIG. 4.
Figure 5B:
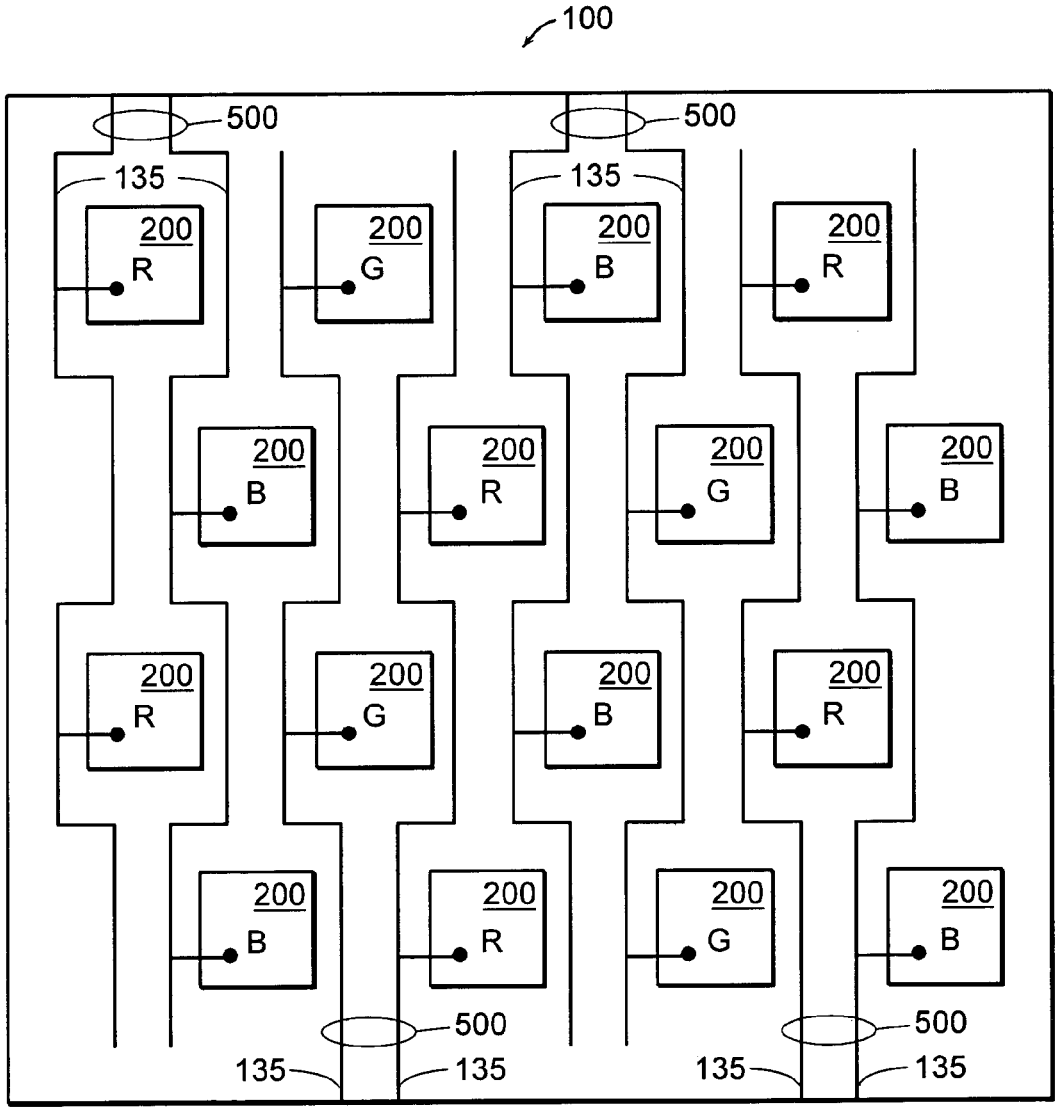
FIG. 5B is a schematic representation of a typical pixel layout for a color display for the data scanner of FIG. 4.

FIG. 5A shows pixel array layout connections required to convert the digital signal to an analog signal using the switch 410 and column load capacitances 160 for B/W displays, while FIG. 5B shows pixel array layout connections for color displays. As shown, a rectangular layout is commonly used for B/W displays and a "delta" layout is commonly used for color displays. Each column line pair 500 is connected to one pixel 200 per row. The column pairs 500 have matched column capacitances if they have the same number of left and right connected pixels 200. The use of column line pairs 500 suggests more display area, which reduces the active pixel aperture. However, in anticipated technology, the pixel aperture is limited by optical, LC, and other issues and not by the interconnect pitch.

Figure 6:
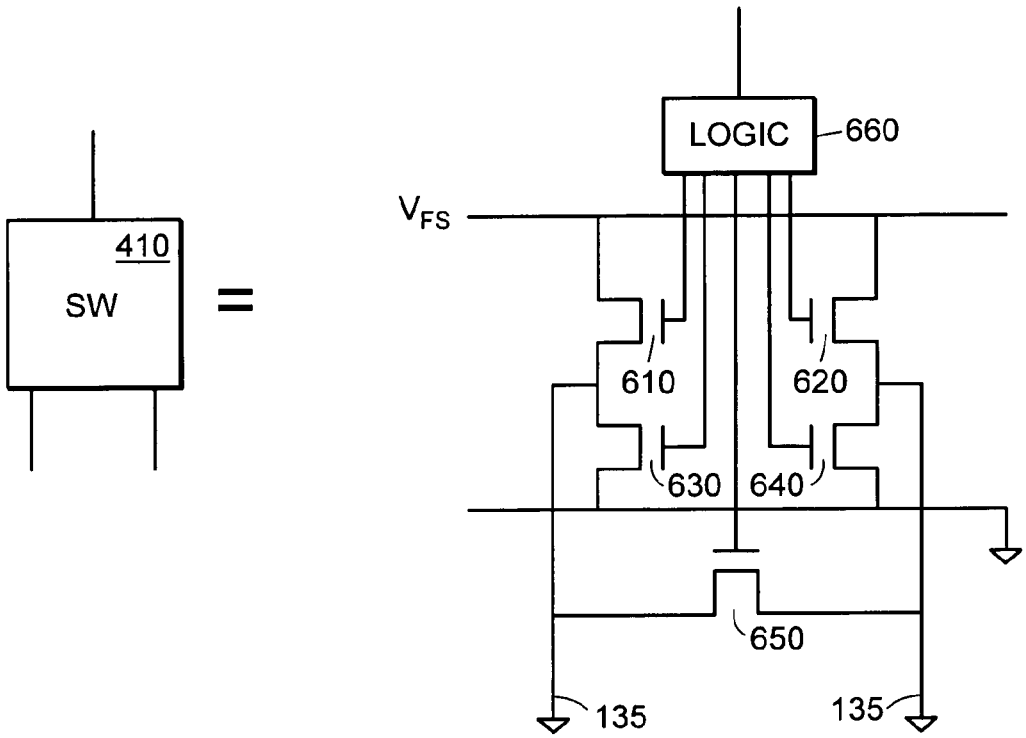
FIG. 6 is a circuit diagram of a switch device of FIG. 4.

FIG. 6 shows a circuit diagram of the switch 410 of FIG. 4. The switch 410 includes five MOSFET transistors 610, 620, 630, 640, and 650. The gates of each MOSFET are connected to a logic circuit 660. The logic circuit 660 contains the digital data received from the row buffer 110 (FIG. 4) and distributes the digital data to the MOSFETs. MOSFETs 610 and 630 perform a similar operation of switch 310 of FIG. 3. MOSFET 610 can drive the column high to VFS, MOSFET 630 can drive it low, or both MOSFETs can be turned off for an open connection. Similarly, MOSFET 650 performs a similar operation of switch 320 of FIG. 3, connecting the two columns to equalize charge. Optional MOSFETs 620 and 640 are provided for symmetry to MOSFETs 610 and 630. The circuit can be operated with MOSFETs 610 and 630 driving the left column line while, charge is accumulating on the right column line, or else with MOSFETs 620 and 640 driving the right column line, while charge is accumulating on the left column line.

FIG. 6 uses n-channel MOSFETs for switches. However, P-channel MOSFET or complementary pairs of n- and p-channel MOSFETs may also be used. Additional MOSFETs may be used for charge injection cancellation, using the well-known technique in which both source and drain of a compensating MOSFET are connected to the high-impedance side of the switch, and in which the gate of the compensating MOSFET is driven with the logical inverse of the gate of the switch MOSFET, and in which the compensating MOSFET is one half the size of the switch MOSFET.

While this invention has been particularly shown and described with references to particular embodiments, it will be understood by those skilled in the art that various changes in form and details may be made without departing from the scope of the invention encompassed by the appended claims.

What is claimed is:

1. A data scanner for driving a liquid crystal display (LCD), comprising:

a data bus, the data bus containing digital data;

a row buffer coupled to the data bus for receiving and distributing the digital data received from the data bus; and a switch network coupled to the row buffer, the switch network converting digital data received from the row buffer to analog data using column load capacitances on pairs of column lines of the LCD; and wherein the switch network includes a plurality of switching devices, each swiching device coupled to a respective pair of column lines of the LCD.

2. The device of claim 1, wherein each switching device includes:

a logic circuit, the logic circuit receiving digital data from the row buffer;

at least three MOSFETs, the MOSFETs converting the received digital data received from the logic circuit to analog data and transmitting the analog data through respective column lines.

3. The device of claim 2, wherein the MOSFETs are n-channel MOSFETS.

4. The device of claim 2, wherein the MOSFETs are p-channel MOSFETS.

5. The device of claim 2, wherein the MOSFETs are a combination of n-Channel MOSFETS and p-channel MOSFETs.

6. The device of claim 1, where a first column line of the pair of column lines is coupled to alternating pixels in a first column of pixels and a second column line of the pair of column lines is coupled to alternating pixels in a second column of pixels, the pixels of the first column line being in alternating rows with respect to the pixels in the second column line.

7. The device of claim 6, where the pixels are arranged in a rectangular layout.

8. The of claim 6, where the pixels are arranged in a delta layout.

9. The data scanner of claim 1, wherein the switch network converts digital data received from the row buffer to analog data using column load capacitances on pairs of column lines of the LCD, the pairs of column lines including at least a first column line and a second column line, the switch network being connected to each of the first and the second column lines.

10. The data scanner of claim 9, wherein the first and the second column lines are separated, and spaced from one another.

11. The data scanner of claim 1, wherein the switch network converts digital data received from the row buffer to analog data using column load capacitances on adjacent pairs of column lines of the LCD.

12. A method for driving a liquid crystal display (LCD), comprising:

receiving digital data in a row buffer;

distributing the digital data to a switch network;

converting the digital data to analog data using column load capacitances on pairs of column lines of the LCD; and wherein the switch network includes a plurality of switching devices, each switching device coupled to a respective pair of column lines of the LCD.

13. The method of claim 12, wherein each switching device includes:

a logic circuit, the logic circuit receiving digital data from the row buffer; and at least three MOSFETs, the MOSFETs converting the received digital data received from the logic circuit to analog data and transmitting the analog data through respective column lines.

14. The method of claim 13, wherein the MOSFETs are n-channel MOSFETS.

15. The method of claim 13, wherein the MOSFETs are p-channel MOSFETS.

16. The method of claim 13, wherein the MOSFETs are a combination of n-channel MOSFETS and p-channel MOSFETs.

17. The method of claim 12, where a first column line of the pair of column lines is coupled to alternating pixels in a first column of pixels and a second column line of the pair of column lines is coupled to alternating pixels in a second column of pixels, the pixels of the first column line being in alternating rows with respect to the pixels in the second column line.

18. The method of claim 17, where the pixels are arranged in a rectangular layout.

19. The method of claim 17, where the pixels are arranged in a delta layout.

* * * * *

UNITED STATES PATENT AND TRADEMARK OFFICE

CERTIFICATE OF CORRECTION

PATENT NO. : 7,595,782 B2
APPLICATION NO. : 10/775765
DATED : September 29, 2009
INVENTOR(S) : Frederick P. Herrmann It is certified that error appears in the above-identified patent and that said Letters Patent is hereby corrected as shown below:

Claim 1, Column 4, line 64, delete "swiching" and insert --switching--.

Claim 5, Column 5, line 12, delete "n-Channel" and insert --n-channel--.

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,595,782 B2
APPLICATION NO. : 10/775765
DATED : September 29, 2009
INVENTOR(S) : Frederick P. Herrmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1624 days.

Signed and Sealed this

Twenty-eighth Day of September, 2010

David J. Kappos

David J. Kappos
*Director of the United States Patent and Trademark Office*